US008102121B2

(12) United States Patent
Brock et al.

(10) Patent No.: US 8,102,121 B2
(45) Date of Patent: Jan. 24, 2012

(54) SINGLE-ENDED CERAMIC DISCHARGE LAMP

(75) Inventors: Lori R. Brock, Ipswich, MA (US); Arlene Hecker, Beverly, MA (US); Jeffrey T. Neil, North Reading, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 1089 days.

(21) Appl. No.: 11/678,702

(22) Filed: Feb. 26, 2007

(65) Prior Publication Data

US 2008/0203921 A1 Aug. 28, 2008

(51) Int. Cl.
*H01J 17/18* (2012.01)

(52) U.S. Cl. ..... 313/625; 313/567

(58) Field of Classification Search ..... 313/623, 313/627–643, 567, 111–117, 25–27, 318.01–318.09; 439/615, 739; 445/24, 26, 29, 22
See application file for complete search history.

(56) References Cited

U.S. PATENT DOCUMENTS

| | | | | |
|---|---|---|---|---|
| 3,731,133 | A * | 5/1973 | McRae et al. | 313/113 |
| 4,020,379 | A * | 4/1977 | Manning | 313/600 |
| 4,079,167 | A * | 3/1978 | Scott et al. | 428/409 |
| 4,420,799 | A | 12/1983 | Miller | |
| 4,490,642 | A * | 12/1984 | Dobrusskin et al. | 313/25 |
| 4,665,341 | A * | 5/1987 | Imamura et al. | 313/493 |
| 4,877,997 | A | 10/1989 | Fein | |
| 5,003,214 | A | 3/1991 | Morris et al. | |
| 5,138,218 | A * | 8/1992 | Honda et al. | 313/25 |
| 5,528,101 | A * | 6/1996 | Gosslar et al. | 313/493 |
| 5,532,552 | A * | 7/1996 | Heider et al. | 313/623 |
| 5,541,480 | A | 7/1996 | Renardus et al. | |
| 5,604,406 | A | 2/1997 | Gaus | |
| 5,721,465 | A | 2/1998 | Roberts | |
| 5,861,714 | A * | 1/1999 | Wei et al. | 313/625 |
| 6,200,005 | B1 | 3/2001 | Roberts et al. | |
| 6,285,131 | B1 | 9/2001 | Kiss et al. | |
| 6,316,867 | B1 | 11/2001 | Roberts et al. | |
| 6,339,279 | B1 * | 1/2002 | Miyamoto et al. | 313/113 |
| 6,351,058 | B1 | 2/2002 | Roberts | |
| 6,445,129 | B1 | 9/2002 | Seiler et al. | |
| 6,536,918 | B1 | 3/2003 | Boeroeczki et al. | |
| 6,597,087 | B2 | 7/2003 | Roberts et al. | |
| 6,602,104 | B1 | 8/2003 | Roberts | |
| 6,806,627 | B2 * | 10/2004 | Manning | 313/113 |

(Continued)

FOREIGN PATENT DOCUMENTS

EP 1 111 654 A1 6/2001

(Continued)

OTHER PUBLICATIONS

EP 08 72 5231, Communication of extended European search report dated Dec. 29, 2010.

*Primary Examiner* — Nimeshkumar D. Patel
*Assistant Examiner* — Donald Raleigh
(74) *Attorney, Agent, or Firm* — Robert F. Clark; Andrew Martin

(57) ABSTRACT

A single-ended ceramic discharge lamp is described which has an integral optical surface such as a parabolic or elliptical reflector. The single-ended configuration eliminates the need for the mounting structures found in double-ended lamps that can interfere with the light emitted from the lamp, particularly in focused beam applications.

30 Claims, 5 Drawing Sheets

U.S. PATENT DOCUMENTS

| | | | | |
|---|---|---|---|---|
| 6,955,579 | B2 * | 10/2005 | Hecker et al. | 445/27 |
| 7,358,666 | B2 * | 4/2008 | Bewlay et al. | 313/547 |
| 2003/0076041 | A1 * | 4/2003 | Honda et al. | 313/634 |
| 2003/0098652 | A1 * | 5/2003 | Beech et al. | 313/634 |
| 2003/0193281 | A1 * | 10/2003 | Manning | 313/113 |
| 2004/0124776 | A1 * | 7/2004 | Iorio et al. | 313/625 |
| 2004/0135510 | A1 * | 7/2004 | Bewlay et al. | 313/624 |
| 2004/0185741 | A1 * | 9/2004 | Hecker et al. | 445/22 |
| 2004/0207336 | A1 * | 10/2004 | Furukawa | 315/219 |
| 2005/0007020 | A1 * | 1/2005 | Tsuda et al. | 313/634 |
| 2005/0211370 | A1 | 9/2005 | Lima et al. | |
| 2005/0212433 | A1 | 9/2005 | Perez et al. | |
| 2006/0138962 | A1 * | 6/2006 | Wei et al. | 313/634 |
| 2006/0170361 | A1 * | 8/2006 | Brock et al. | 313/634 |
| 2007/0018582 | A1 * | 1/2007 | Tsuda et al. | 313/636 |
| 2007/0138926 | A1 * | 6/2007 | Brown et al. | 313/110 |

FOREIGN PATENT DOCUMENTS

| | | |
|---|---|---|
| EP | 1111654 | 6/2001 |
| EP | 1544889 | 6/2005 |
| GB | 2103872 | 2/1983 |

* cited by examiner

SINGLE-ENDED CERAMIC DISCHARGE LAMP

BACKGROUND OF THE INVENTION

Double-ended ceramic discharge lamps, i.e. lamps in which the electrodes enter the ceramic discharge vessel from opposite sides, are well known. For example, U.S. Pat. No. 5,721,465 describes a xenon arc lamp with a cylindrical ceramic body into which an elliptical reflector is molded and a quartz window is mounted opposite the reflector. The lamp has opposed electrodes: one which extends into the discharge vessel from the base of the reflector, the other from the opposite side where the window is located, i.e., the light-emitting end. Similar configurations are found in U.S. Pat. Nos. 6,200,005, 6,285,131, 6,351,058, 6,597,087, 6,602,104 and 6,316,867. However, a common disadvantage with these lamps is that the window-side electrode and its mounting structure obstruct a portion of the light exiting the window.

Also known are singled-end ceramic discharge lamps, i.e., lamps in which the electrodes enter the discharge vessel from the same side. For example, European Patent Application No. EP 1 111 654 A1 describes several single-ended configurations. Although one embodiment is shown with an integral lens in the dome to enhance light intensity distribution, the discharge vessels do not otherwise attempt to focus the arc as in the above-described double-ended lamps. Examples of other single-ended lamps are shown in U.S. Patent Publication Nos. 2005/0211370 and 2005/0212433 which describe different electrode/capillary configurations but also do not provide a means for focusing the arc.

SUMMARY OF THE INVENTION

It is an object of the invention to obviate the disadvantages of the prior art.

It is another object of the invention to provide a ceramic discharge lamp having an integral optical surface.

It is a further object of the invention to provide a ceramic discharge lamp that does not have a mounting structure that obstructs the emitted light.

In accordance with an object of the invention, there is provided a single-ended ceramic discharge lamp that comprises a discharge vessel formed of a ceramic material. The discharge vessel has a cupulate body portion and a stem. The cupulate body portion is rotationally symmetric about a central axis and has an inner surface, an outer surface, a rim and a base. The stem extends outwardly from the base and has two electrode assemblies. A light-transmissive end cap is sealed to the rim of the cupulate body portion. The end cap and the cupulate body portion enclose a discharge cavity that contains a discharge medium. Each electrode assembly has an electrode tip that protrudes into the discharge cavity, a feedthrough portion that is sealed in the stem, and a lead end for connecting to a source of electric power. The electrode tips of the electrode assemblies define an arc gap. At least one of the inner surface or outer surface of the cupulate body portion comprise an optical surface wherein the arc gap is positioned at a focus of the optical surface.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

Figure 1:
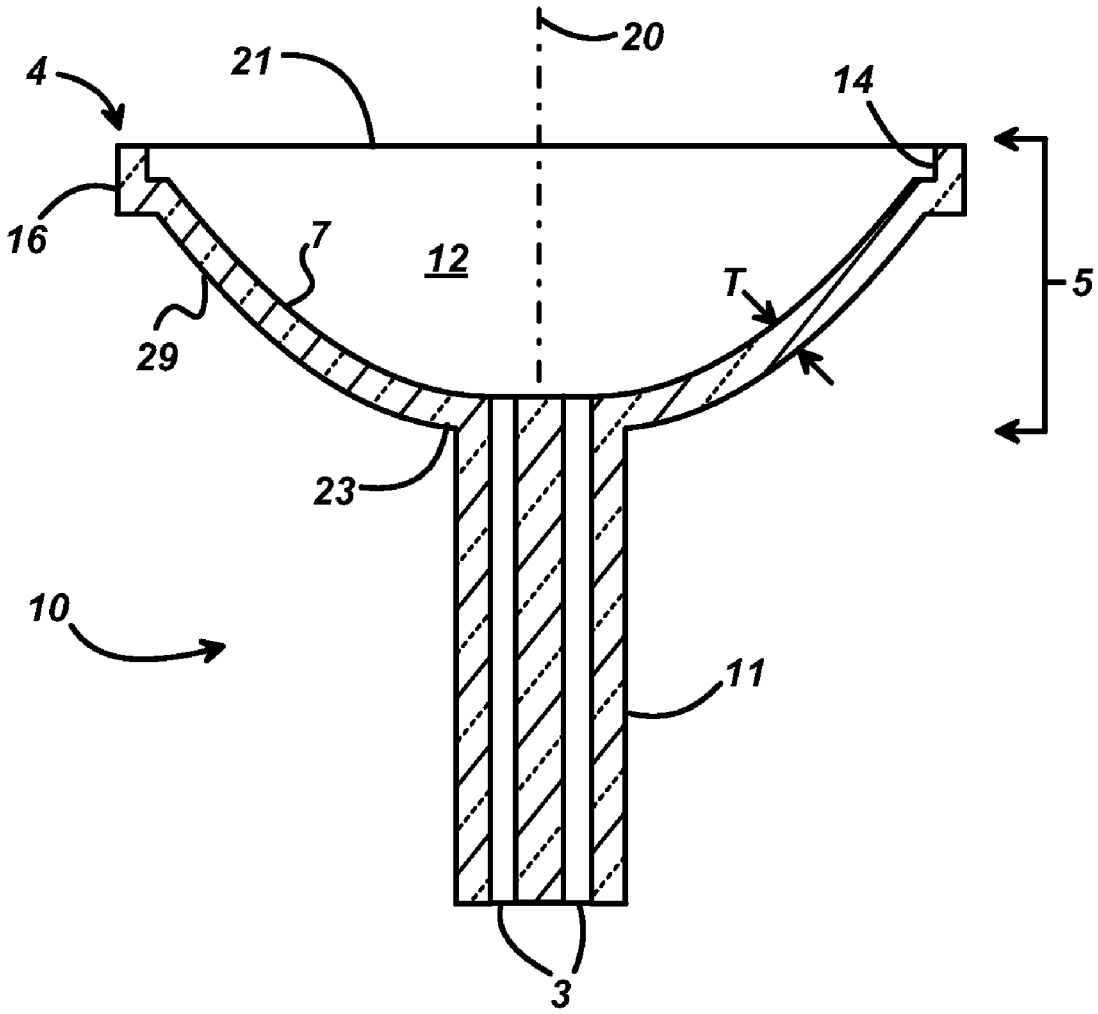
FIG. 1 is a cross-sectional illustration of an embodiment of the ceramic discharge vessel of the single-ended ceramic discharge lamp of this invention.
Figure 2:
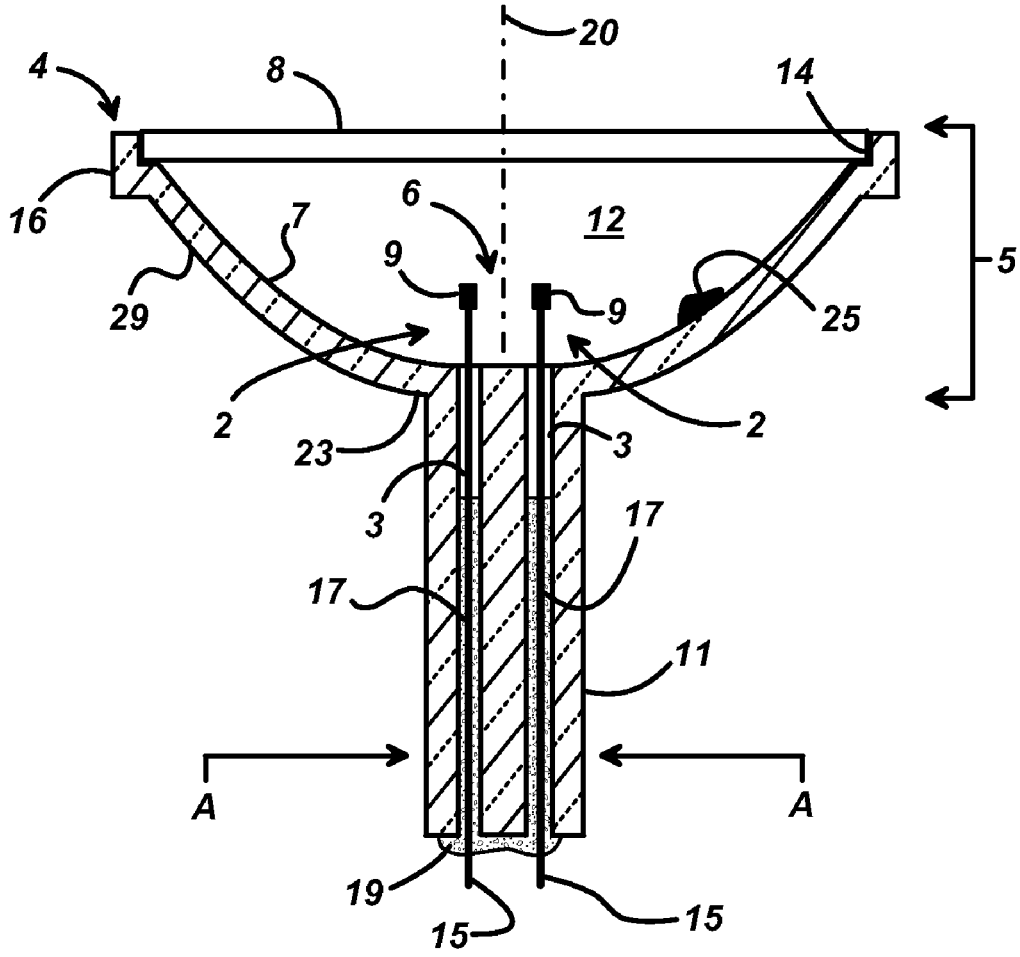
FIG. 2 is a cross-sectional illustration of an embodiment of the singled-ended ceramic discharge lamp of this invention.

FIG. 1 is a cross-sectional view of a preferred embodiment of the discharge vessel 10 of the single-ended ceramic discharge lamp of this invention. The discharge vessel 10 is constructed of a ceramic material, preferably polycrystalline alumina (PCA), although other ceramic materials such as yttrium aluminum garnet, aluminum oxynitride, or aluminum nitride may be used. The discharge vessel 10 has a cupulate (cup-shaped) body portion 5 and stem 11 which extends outwardly from base 23 of cupulate body portion 5. The cupulate body portion 5 is rotationally symmetric about central axis 20 and defines discharge cavity 12. Flange 16 extends outwardly from rim 4 of open end 21. The flange 16 is shown with a rabbet 14 on the inner edge for accepting and sealing to a light-transmissive end cap 8 as shown in FIG. 2. Openings 3 are provided in the stem 11 for receiving electrode assemblies as shown in FIG. 2.

The cupulate body portion 5 has a substantially uniform wall thickness T, in the region between flange 16 and stem 11. The thickness T is preferably between 0.3 and 2.0 mm, and more preferably 0.8 mm. Some thickening of the wall immediately adjacent to the flange and stem may be desirable increase the robustness of the discharge vessel.

At least one of inner surface 7 or outer surface 29 of the cupulate body portion 5 is formed as an optical surface that may be designed to reflect and/or focus a portion of the light emitted by the arc discharge. Preferably, the optical surface comprises a parabolic surface of revolution formed about central axis 20. The parabolic surface is intended to function as a parabolic reflector for directing at least a portion of the light emitted by the discharge out of the open end 21 of cupulate body portion 5. The optical surface may be polished to enhance its reflectivity or coated with a reflective material. The optical surface may also be formed as an elliptical reflector depending on the particular optical characteristics desired for the lighting application. For example, a parabolic reflector would be useful in forming a more uniform beam pattern for flood lighting or automotive headlamp applications whereas an elliptical reflector would be useful to focus the light into a light guide or for projection applications. Other useful optical surfaces include aconic and spherical reflectors.

It is preferred to form the discharge vessel as a unitary piece (as shown) using a conventional ceramic molding process such as injection molding, gel-casting, or isostatic pressing. However, the discharge vessel may be formed as multiple ceramic pieces which are then joined by conventional methods. Preferably, the ceramic material of the discharge vessel is opaque in order to reduce the amount of light exiting the lamp through the walls of the discharge vessel. The ability to use an opaque ceramic for the discharge vessel rather than a translucent or transparent ceramic as is required for other discharge lamps should reduce the manufacturing cost of lamp since lower purity alumina powders may be used.

Figure 4:
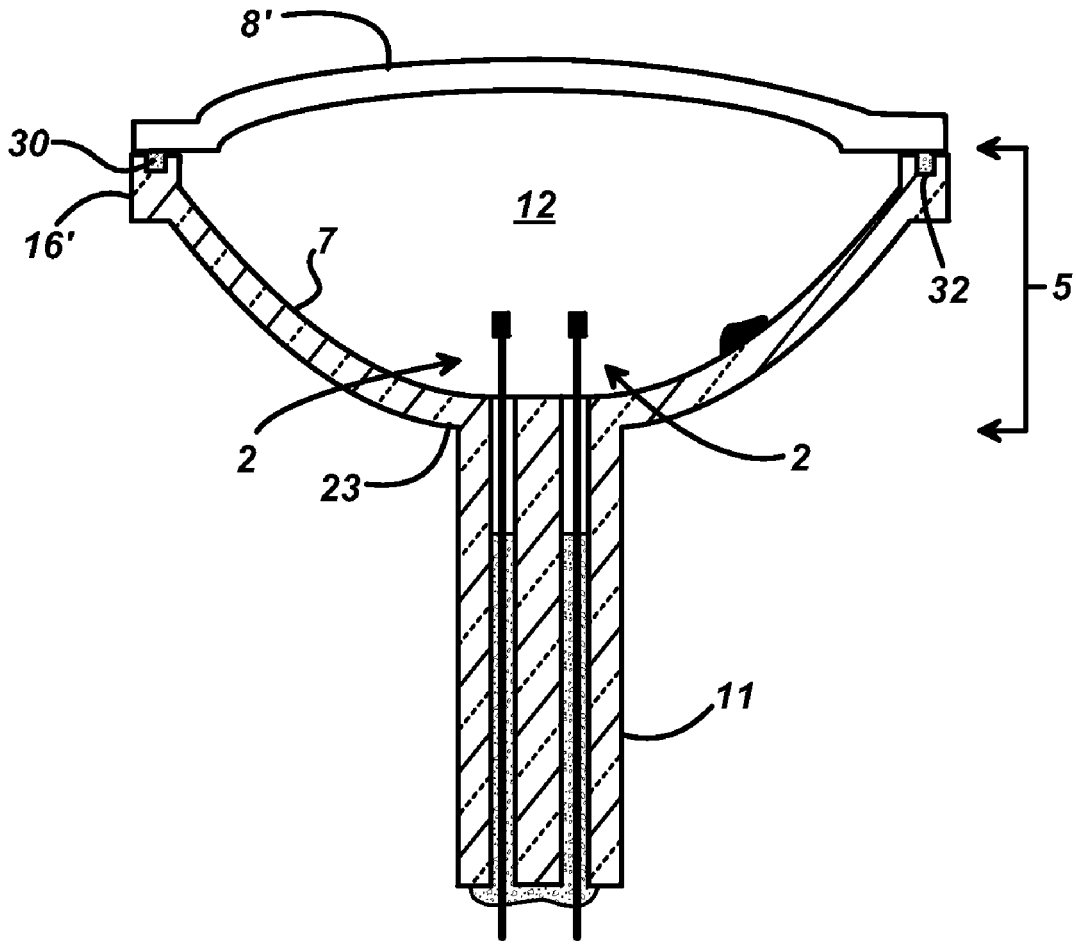
FIG. 4 is a cross-sectional illustration of a first alternate embodiment of the lamp shown in FIG. 2.
Figure 5:
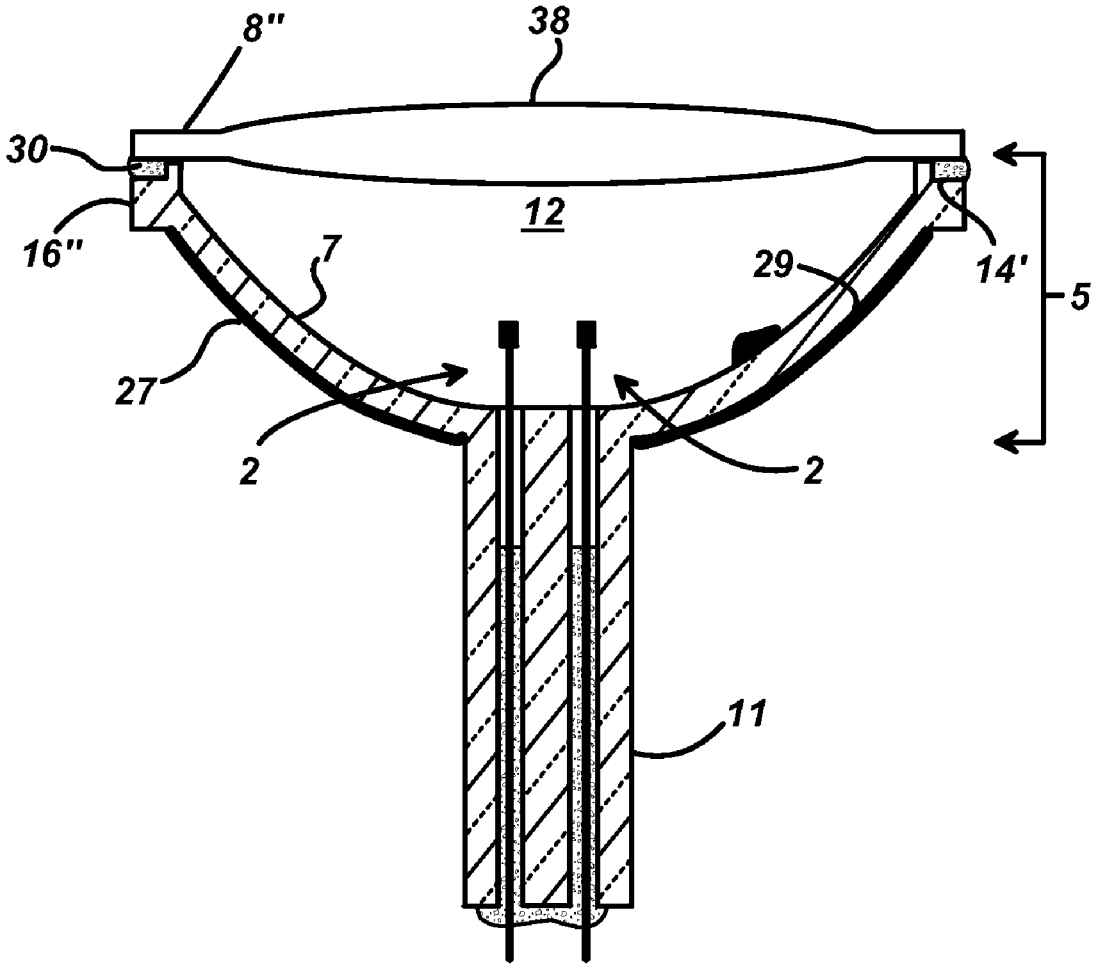
FIG. 5 is a cross-sectional illustration of a second alternate embodiment of the lamp shown in FIG. 2.

Referring now to FIG. 2, there is shown a cross-sectional illustration of an embodiment of the singled-ended ceramic lamp. A light-transmissive end cap 8 is shown sealed to rim 4 of cupulate body portion 5 thereby enclosing discharge cavity 12. Preferably, the light-transmissive end cap 8 is a flat, circular sapphire window having a thickness on the order of 1 mm. However, other transparent or translucent ceramic materials may also be used, e.g., polycrystalline alumina, quartz, or aluminum oxynitride. The end cap 8 may further have a dome shape (FIG. 4) or a lenticular shape (FIG. 5) to further influence the distribution of light passing out through the end cap. The end cap 8 may be sealed to the rim 4 with a frit material or by an interference fit caused by differential shrinkage of the ceramic parts as is well known in the art. In this embodiment, the end cap 8 is a flat, circular sapphire window that sits in the rabbet 14 formed in the inner edge of flange 16. The window is then sealed to the flange by differential shrinkage during sintering of the discharge vessel. When the manufacturing process requires that the electrode assemblies be inserted into openings 3 through the open end 21 of the discharge vessel, then the use of a frit material to seal the window to the flange is preferred. This method of insertion is particularly advantageous when the electrode tips 9 are angled toward each other. Other seal configurations are shown in FIGS. 4 and 5 using frit or eutectic materials. Although preferred, it is not necessary to form a flange at the rim 4 of the open end 21 for sealing to the end cap 8. For example, the flat, circular sapphire window could be sealed directly to a flat annular PCA rim surface with a eutectic material such as $Y_2O_3$—$Al_2O_3$ as is known in the art.

Figure 3:
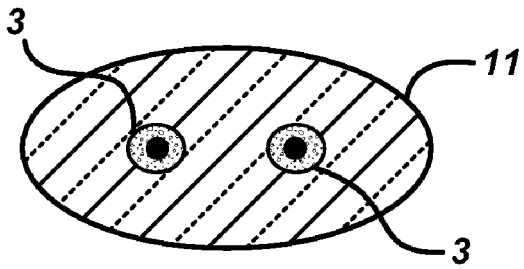
FIG. 3 is an enlarged cross-sectional view through line A-A of the stem of the lamp shown in FIG. 2.

Referring again to FIG. 2, stem 11 extends outward from base 23 and has two openings 3 which permit electrode assemblies 2 to pass through. Each electrode assembly 2 typically has three sections: an electrode tip 9, a feedthrough section 17, and a lead end 15 for connecting the lamp to a source of electric power (not shown). The stem 11 is preferably centered on central axis 20. An enlarged cross section of stem 11 through line A-A is shown in FIG. 3. In this embodiment, the cross-sectional profile of stem 11 is generally oval, however, it is possible to use other stem geometries ranging from cylindrical or fluted columnar shapes to rectilinear shapes including wedge-shaped stems.

Figure 6:
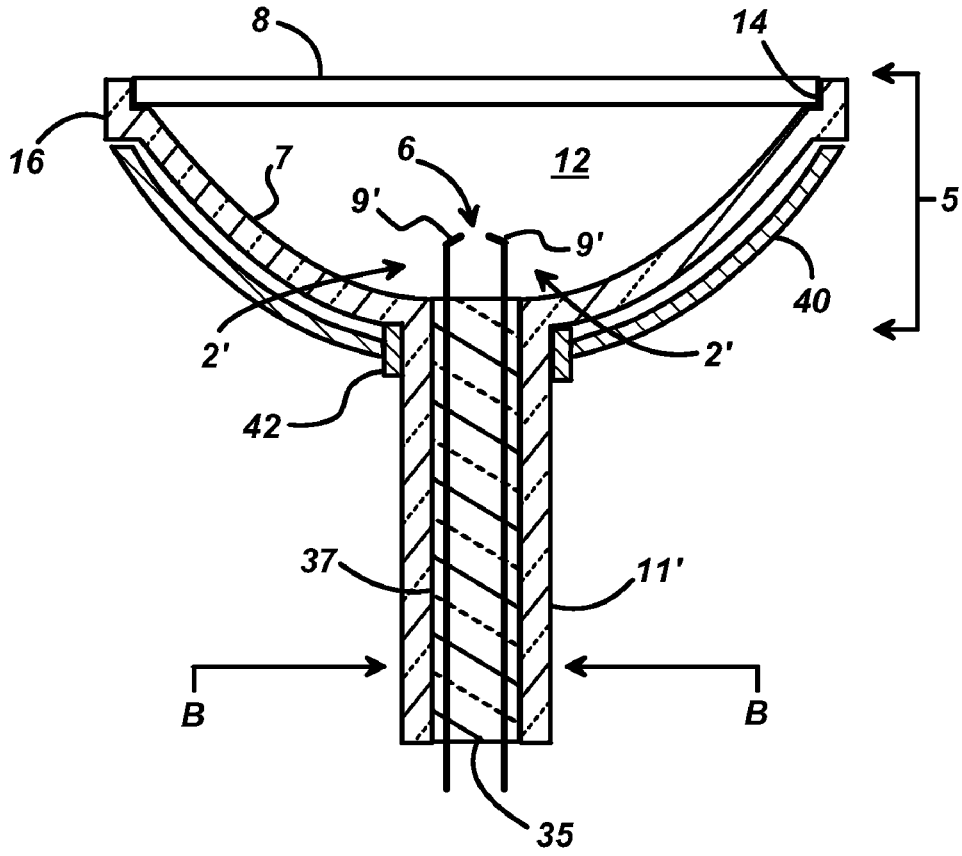
FIG. 6 is a cross-sectional illustration of a third alternate embodiment of the lamp shown in FIG. 2.

The feedthrough sections 17 of the electrode assemblies 2 are sealed in their respective opening 3 with a frit material 19. A preferred frit material for this purpose is a 65% $Dy_2O_3$-10% $Al_2O_3$-25% $SiO_2$ frit (% by weight). The electrode assemblies 2 may be comprised of separate sections that have been welded or otherwise joined together, or may be formed as a single piece, e.g., a tungsten or molybdenum wire. Electrode tips 9 shown in FIG. 2 have a coil welded to the tip which forms the point of arc attachment. However, the electrode tip 9 may be formed without the coil as shown in FIG. 6. In this embodiment, inner surface 7 and outer surface 29 are formed as a parabolic reflectors, the gap 6 between the electrode tips 9 where the arc discharge occurs is positioned approximately at the focus of the inner parabolic surface. However, in some embodiments it may be desirable to place the arc gap at an intermediate position between the focii of the two parabolic surfaces or even at the focus of the outer parabolic surface. A narrow arc gap is preferred in order to take better advantage of the optical properties of the parabolic reflector.

A discharge medium is contained in the discharge cavity 12. Preferably, the discharge medium comprises a solid fill 25 and an inert gas such as argon or xenon. More preferably, the solid fill contains at least one metal halide e.g., NaI and some combination of $DyI_3$, $Tm_3$, $HoI_3$, TlI, and LiI. The metal halide fill also may be combined with a small amount of mercury. Other discharge media include high pressure xenon gas or mercury, depending upon the desired spectrum of light to be emitted by the lamp.

In a first alternate embodiment shown in FIG. 4, the singled-ended ceramic lamp has a domed end cap 8' which is sealed to flange 16' by a frit material 30. The frit material 30 is contained in a groove 32. End cap 8' extends to the outer edge of flange 16' and is sealed to the top surface of flange 16' instead of being seated in a rabbet. The frit material 30 may be a conventional frit such as $Dy_2O_3$—$Al_2O_3$—$SiO_2$ or it may be a eutectic material such as $Y_2O_3$—$Al_2O_3$.

In a second alternate embodiment shown in FIG. 5, the end cap 8" has a lenticular portion 38 for focusing the light emitted by the lamp. Having a lens formed in the end cap 8" is particularly advantageous for applications wherein the light needs to be focused into a light guide such as a fiber optic bundle. Like the embodiment shown in FIG. 4, the end cap 8" extends to the outer edge of flange 16". However, the frit material 30 is contained in a rabbet 14' formed in the outer end of flange 16". In addition, the outer surface 29 of the cupulate body portion 5 has been provided with a coating 27. The coating may be a dark, light-absorbing coating such as a tungsten/alumina cermet that is designed to further reduce the amount of light exiting out the back of the lamp. The coating 27 also may be a reflective coating that is designed to reflect light back toward the discharge cavity 12 thereby increasing the amount of light exiting end cap 8". The reflective coating may also comprise a multi-layer dichroic coating that is designed to reflect visible radiation and allow infrared radiation to pass through and out the back of the lamp. It may also be desirable in some cases for the coating to reflect infrared radiation back into the discharge vessel to increase efficiency. A reflective coating may also be applied to the inner surface of the discharge vessel. Such a coating must be capable of withstanding the environment inside the discharge vessel, particularly when the lamp is in operation, while maintaining its reflective properties.

Figure 7:
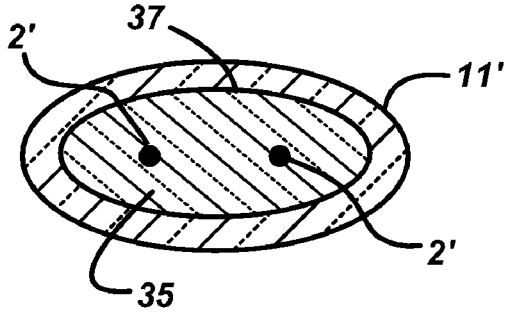
FIG. 7 is an enlarged cross-sectional view through line B-B of the stem of the lamp shown in FIG. 6.

In a third alternate embodiment shown in FIGS. 6 and 7, the stem 11' has a wide single opening 37 that accepts a ceramic insert 35. In this embodiment, the electrode assemblies 2' comprise tungsten or tungsten alloy wires that have been sealed directly to insert 35 without a frit material. This is better seen in FIG. 7 which is a cross section of the stem 11' though line B-B. This stem configuration allows the orientation of the electrodes to be fixed prior to inserting them into the discharge vessel. In addition, it permits the electrode tips 9' to be angled towards each other to prevent migration of the arc down the electrode assemblies. Because of the improved ability to fix the arc location, a narrower arc gap 6 may be realized. Once the electrodes have been fixed in the insert 35, the insert 35 may then be sealed in opening 37 either with or without a frit material. This embodiment of the single-ended lamp is further shown with a close-fitting metal reflector 40 which is mounted on stem 11' using collar 42. Also, no solid fill is used. Instead, the discharge cavity 12 only contains a gaseous fill such as xenon gas.

While there have been shown and described what are at present considered to be the preferred embodiments of the invention, it will be apparent to those skilled in the art that various changes and modifications can be made herein without departing from the scope of the invention as defined by the appended claims.

We claim:

1. A single-ended ceramic discharge lamp comprising:

a discharge vessel, the discharge vessel having a cupulate body portion and a stem both formed of a ceramic material, the cupulate body portion being rotationally symmetric about a central axis and having an inner surface, an outer surface, a rim and a base, the stem extending outwardly from the base and having two electrode assemblies;

a light-transmissive end cap sealed to the rim of the cupulate body portion, the end cap and the cupulate body portion enclosing a discharge cavity, the discharge cavity containing a discharge medium;

each electrode assembly having an electrode tip that protrudes into the discharge cavity, a feedthrough portion that is sealed in the stem, and a lead end for connecting to a source of electric power, the electrode tips of the electrode assemblies defining an arc gap; and at least one of the inner surface or outer surface of the cupulate body portion comprising an optical surface wherein the arc gap is positioned at a focus of the optical surface.

2. The discharge lamp of claim 1 wherein the optical surface is a parabolic reflector.

3. The discharge lamp of claim 1 wherein the optical surface is an elliptical reflector.

4. The discharge lamp of claim 1 wherein the stem has two openings that each receive one of the electrode assemblies, and the feedthrough portions of the electrode assemblies are sealed in the respective opening with a frit material.

5. The discharge lamp of claim 1 wherein the stem has a single opening to receive a ceramic insert and the electrode assemblies are sealed in the ceramic insert which is positioned and sealed in the single opening.

6. The discharge lamp of claim 5 wherein the electrode tips of the electrode assemblies are angled toward each other.

7. The discharge lamp of claim 1 wherein light-transmissive end cap is domed.

8. The discharge lamp of claim 1 wherein light-transmissive end cap has a lenticular portion.

9. The discharge lamp of claim 1 wherein the rim of the cupulate body portion has a flange having a rabbet formed in an inner edge for receiving the light-transmissive end cap.

10. The discharge lamp of claim 9 wherein the light-transmissive end cap is a flat, circular sapphire window that is sealed to the rim by an interference fit.

11. The discharge lamp of claim 1 wherein the rim of the cupulate body portion has a flange having a rabbet formed on an outer edge, the rabbet containing a frit material that seals the light-transmissive end cap to the rim.

12. The discharge lamp of claim 1 wherein the rim of the cupulate body portion has a flange having a groove, the groove containing a frit material that seals the light-transmissive end cap to the rim.

13. The discharge lamp of claim 1 wherein the lamp has a close-fitting metal reflector mounted on the stem.

14. The discharge lamp of claim 1 wherein the outer surface has a coating.

15. The discharge lamp of claim 14 wherein the coating is a tungsten-alumina cermet.

16. The discharge lamp of claim 14 wherein the coating is a multilayer dichroic coating.

17. The discharge lamp of claim 1 wherein the lamp has a reflective coating on the inner surface and the inner surface comprises an optical surface.

18. A single-ended ceramic discharge lamp comprising:

a discharge vessel, the discharge vessel having a cupulate body portion and a stem both integrally formed of a continuous polycrystalline alumina, the cupulate body portion being rotationally symmetric about a central axis and having a rim, a base, and an inner reflector surface, the inner reflector surface comprising a parabolic or elliptical reflector, the cupulate body portion having a wall thickness that is substantially uniform in a region between the rim and the base, the stem extending outwardly from the base and having two electrode assemblies;

a sapphire window sealed to the rim of the cupulate body portion, the window and the cupulate body portion enclosing a discharge cavity, the discharge cavity containing a discharge medium; and each electrode assembly having an electrode tip that protrudes into the discharge cavity, a feedthrough portion that is sealed in the stem, and a lead end for connecting to a source of electric power, the electrode tips defining an arc gap, the arc gap being positioned at a focus of the inner reflector surface.

19. The discharge lamp of claim 18 wherein the wall thickness is from 0.3 mm to 2.0 mm.

20. The discharge lamp of claim 18 wherein the wall thickness is 0.8 mm.

21. The discharge lamp of claim 18 wherein the polycrystalline alumina is opaque.

22. The discharge lamp of claim 18 wherein the stem has two openings that each receive one of the electrode assemblies, and the feedthrough portions of the electrode assemblies are sealed in the respective opening with a frit material.

23. The discharge lamp of claim 18 wherein the stem has a single opening to receive a ceramic insert and the electrode assemblies are sealed in the ceramic insert which is positioned and sealed in the single opening.

24. The lamp of claim 18 wherein an outer surface of the discharge vessel has a coating comprising a tungsten/alumina cermet or a multilayer dichroic coating.

25. The lamp of claim 18 wherein the lamp has a reflective coating on the inner reflector surface.

26. The discharge lamp of claim 18 wherein the lamp has a close-fitting metal reflector mounted on the stem.

27. The discharge lamp of claim 18 wherein the rim of the cupulate body portion has a flange having a rabbet formed in an inner edge for receiving the sapphire window and the sapphire window is sealed to the rim by an interference fit.

28. The discharge lamp of claim 18 wherein the electrode tips are angled toward each other.

29. A single-ended ceramic discharge lamp comprising:

a discharge vessel formed of a ceramic material, the discharge vessel having a cupulate body portion and a stem, the cupulate body portion being rotationally symmetric about a central axis and having an inner surface, an outer surface, a rim and a base, the stem extending outwardly from the base and having two electrode assemblies;

a light-transmissive end cap sealed to the rim of the cupulate body portion, the end cap and the cupulate body portion enclosing a discharge cavity, the discharge cavity containing a discharge medium;

each electrode assembly having an electrode tip that protrudes into the discharge cavity, a feedthrough portion that is sealed in the stem, and a lead end for connecting to a source of electric power, the electrode tips of the electrode assemblies defining an arc gap wherein the stem has two openings that each receive one of the electrode assemblies, and the feedthrough portions of the electrode assemblies are sealed in the respective opening with a frit material; and at least one of the inner surface or outer surface of the cupulate body portion comprising an optical surface wherein the arc gap is positioned at a focus of the optical surface.

30. A single-ended ceramic discharge lamp comprising:

a discharge vessel formed of a ceramic material, the discharge vessel having a cupulate body portion and a stem, the cupulate body portion being rotationally symmetric about a central axis and having an inner surface, an outer surface, a rim and a base, the stem extending outwardly from the base and having two electrode assemblies;

a light-transmissive end cap sealed to the rim of the cupulate body portion, the end cap and the cupulate body portion enclosing a discharge cavity, the discharge cavity containing a discharge medium wherein the light-transmissive end cap is a flat, circular sapphire window that is sealed to the rim by an interference fit;

each electrode assembly having an electrode tip that protrudes into the discharge cavity, a feedthrough portion that is sealed in the stem, and a lead end for connecting to a source of electric power, the electrode tips of the electrode assemblies defining an arc gap; and at least one of the inner surface or outer surface of the cupulate body portion comprising an optical surface wherein the arc gap is positioned at a focus of the optical surface.

* * * * *